US006568058B1

(12) United States Patent
Wieland et al.

(10) Patent No.: US 6,568,058 B1
(45) Date of Patent: May 27, 2003

(54) METHOD OF ASSEMBLING A FULLY UPHOLSTERED READY-TO-ASSEMBLE ARTICLE OF FURNITURE

(75) Inventors: Blaine L. Wieland, Fort Wayne, IN (US); Blair Wieland, Leo, IN (US)

(73) Assignee: Home Reserve, Inc., Grabill, IN (US)

( * ) Notice: Subject to any disclaimer, the term of this patent is extended or adjusted under 35 U.S.C. 154(b) by 0 days.

(21) Appl. No.: 09/588,000

(22) Filed: Jun. 6, 2000

Related U.S. Application Data

(63) Continuation-in-part of application No. 09/855,921, filed on May 14, 1997, now Pat. No. 6,267,446.

(60) Provisional application No. 60/185,581, filed on Feb. 28, 2000.

(51) Int. Cl.[7] ..... B68G 7/00; B23P 11/00; A47C 7/00

(52) U.S. Cl. ..... 29/91.1; 29/525.03; 29/525.11; 297/440.11; 297/440.14

(58) Field of Search ..... 29/91.1, 525.02, 29/525.03, 525.04, 525.11; 297/440.1, 440.11, 440.15, 463.1, 440.13, 440.14; 312/263, 264, 265.5

(56) References Cited

U.S. PATENT DOCUMENTS

| | | | | |
|---|---|---|---|---|
| 126,009 | A | | 4/1872 | Beidler |
| 2,279,864 | A | | 4/1942 | Eide |
| 2,334,912 | A | | 11/1943 | Eide |
| 2,364,012 | A | | 11/1944 | Walton et al. |
| 2,418,731 | A | | 4/1947 | Seitz |
| 2,532,863 | A | | 12/1950 | Taylor |
| 2,545,243 | A | | 3/1951 | Rumsey, Jr. |
| 2,660,228 | A | | 11/1953 | Reinhold |
| 2,692,007 | A | | 10/1954 | Christian |
| 2,705,528 | A | * | 4/1955 | Friedlander |
| 2,705,995 | A | * | 4/1955 | McMurtry |
| 2,738,834 | A | | 3/1956 | Jaffe et al. |
| 3,061,165 | A | | 10/1962 | Rench et al. |
| 3,083,889 | A | | 4/1963 | Christensson |
| 3,132,910 | A | * | 5/1964 | Vigna ..... 312/264 |
| 3,458,996 | A | | 8/1969 | Dunbar et al. |
| 3,467,433 | A | | 9/1969 | Lindau et al. |
| 3,540,776 | A | | 11/1970 | Wilson |
| 3,594,056 | A | * | 7/1971 | Sager ..... 312/263 |
| 3,643,997 | A | * | 2/1972 | Gilbert et al. |
| 3,680,916 | A | | 8/1972 | Gilbert et al. |
| 3,704,911 | A | * | 12/1972 | Milakovich |
| 3,747,743 | A | | 7/1973 | Hoffmann, Jr. |
| 3,951,558 | A | * | 4/1976 | Komarov ..... 312/263 |
| 4,030,846 | A | * | 6/1977 | Flototto ..... 403/231 |
| 4,055,924 | A | | 11/1977 | Beaver, Jr. |
| 4,078,842 | A | | 3/1978 | Zur |
| 4,140,065 | A | | 2/1979 | Chacon |

(List continued on next page.)

*Primary Examiner*—David P. Bryant
(74) *Attorney, Agent, or Firm*—Baker & Daniels

(57) ABSTRACT

A fully upholstered, ready-to-assemble article of furniture which may be custom ordered by a consumer, packaged by the seller for shipment to the consumer by a parcel delivery service, and then assembled by the consumer from the packaged components. The article of furniture includes a frame of a plurality of interlocking, planar frame members which are secured together by fasteners received in push-in connector elements. Upholstery coverings, the design of which is custom selected by the consumer, are attached to the frame and secured to one another by hook and loop fasteners. Foam elements are received within a second plurality of upholstery covers which have large openings for receiving the foam elements to provide cushions for the article of furniture. The frame members, upholstery covers, and foam elements are packaged in first, second, and third containers, respectively, which are each light enough to be shipped for home delivery by a parcel delivery service.

8 Claims, 12 Drawing Sheets

U.S. PATENT DOCUMENTS 4,184,608 A 1/1980 Christensson
4,418,514 A 12/1983 Spann
4,466,675 A * 8/1984 Ferdinand et al. ..... 312/263
4,521,928 A 6/1985 Stephenson
4,575,886 A 3/1986 Larson
4,577,816 A 3/1986 Foster
4,593,950 A 6/1986 Infanti
4,601,621 A * 7/1986 Permoda ..... 29/525.02
4,675,929 A 6/1987 Santo
4,679,260 A 7/1987 Frettem
4,697,847 A 10/1987 Herschlag
4,788,727 A 12/1988 Liu
4,820,269 A * 4/1989 Riddell ..... 137/268
4,828,324 A 5/1989 Putnam
4,841,586 A 6/1989 Juster et al.
4,848,839 A * 7/1989 Galardo
4,869,564 A * 9/1989 Lechman ..... 108/180
4,879,775 A 11/1989 Keefer
4,881,779 A 11/1989 Bubien
4,883,317 A 11/1989 Davenport
4,886,326 A * 12/1989 Kuzyk ..... 108/180
4,925,245 A 5/1990 Pendleton et al.
4,928,337 A 5/1990 Chauncey
5,112,110 A * 5/1992 Perkins
5,115,526 A 5/1992 Boyd
5,263,764 A * 11/1993 Laughlin et al.
5,338,095 A * 8/1994 Laughlin et al.
5,415,461 A 5/1995 Sakamoto
5,536,078 A * 7/1996 Novikoff ..... 312/111
5,622,030 A 4/1997 Steed et al.
5,671,492 A 9/1997 Simon
5,678,897 A * 10/1997 Prestia
5,878,470 A * 3/1999 Blansett
6,000,079 A 12/1999 Dranger
6,241,317 B1 * 6/2001 Wu
6,267,446 B1 * 7/2001 Wieland et al.

* cited by examiner

METHOD OF ASSEMBLING A FULLY UPHOLSTERED READY-TO-ASSEMBLE ARTICLE OF FURNITURE

CROSS-REFERENCE TO RELATED APPLICATIONS

This application claims the benefit under Title 35 U.S.C. §120 as a continuation-in-part of application Ser. No. 08/855,921, filed on May 14, 1997, entitled now U.S. Pat. No. 6,276,446, COMPRESSED UPHOLSTERED FURNITURE ASSEMBLY KIT AND METHOD OF MANUFACTURE, and the benefit under Title 35 U.S.C. §119(e) of application Ser. No. 60/185,581, filed Feb. 28, 2000, entitled FULLY UPHOLSTERED, READY-TO-ASSEMBLE ARTICLE OF FURNITURE.

BACKGROUND OF THE INVENTION.

1. Field of the Invention

The present invention relates-generally to custom ordered furniture and the packaging of such furniture for shipment and storage. More particularly, the invention relates to fully upholstered, ready-to-assemble furniture which may be custom ordered by a consumer, packaged by the seller for shipment to the consumer by a parcel delivery service, and then assembled by the consumer from the packaged components.

2. Description of the Related Art

Ready-to-assemble furniture is furniture which is packaged for shipment and storage in disassembled form, with assembly to be done by the consumer or end user. Examples of existing ready-to-assemble non-upholstered furniture include bookcases, television stands, and simple chairs and benches. Furthermore, mass merchandised ready-to-assemble furniture is expected to be rather less expensive to the consumer than comparable pre-assembled furniture or to have distinctive functional features generally not available with its pre-assembled counterpart.

The genre of ready-to-assemble furniture packaged for mass merchandising retail sale and home delivery has generally been limited to pieces of furniture which are utilitarian or hard-surfaced, and which are available in only limited colors or surface finishes. As such, prior ready-to-assemble furniture does not satisfy the need for primary pieces of fully upholstered furniture which may be custom ordered by the consumer, and either delivered to the household of the consumer by a parcel delivery service, or taken home by the consumer from a retail location.

What is needed is comfortable, fully upholstered, ready-to-assemble, and inexpensive furniture of high quality which may be packaged in a compact, easily storable and transportable way, for distribution by mass merchandising and home delivery channels and which can be custom ordered by the purchaser to accommodate a wide variety of consumer decorating tastes.

SUMMARY OF THE INVENTION

The present invention provides fully upholstered, ready-to-assemble furniture which may be custom ordered by a purchaser, shipped directly to the home of the purchaser by a parcel delivery service, and then easily and quickly assembled by the purchaser. The furniture includes a frame having a plurality of planar frame members which are interconnected by interlocking protrusions and cutout portions, as well as by threaded fasteners received in push-in connector elements which are held in recesses within the frame members. A first plurality of upholstery covers cover the frame and are attached to one another by hook and loop fasteners. A second plurality of upholstery covers cover padding elements to form cushions for the article of furniture. For shipment, the article of furniture may be packaged such that the frame members, connector elements, and fasteners are packaged in a first container, the padding elements are packaged in a second container; and the upholstery covers are packaged in a third container. Each one of the first, second, and third containers weigh about 70 pounds or less to allow them to be delivered directly to the home of a consumer by a parcel delivery service.

Further, the present invention uses reduced volume padding in a method of making a kit which provides high quality, ready-to-assemble upholstered furniture. The kit includes a lightweight, compact, easy to handle package or packages well-suited to the shipping, storage and display needs of the mass merchandising industry. The kit, when assembled, provides an article of comfortable, fully upholstered furniture which can match a variety of decors. Interchangeable, fitted decorative coverings are separately provided to cover the furniture and provide continued flexibility and variety in accommodating the consumer's decorating tastes.

The lightweight, compact and maneuverable package or packages are advantageous because they can be efficiently stocked on the display or inventory shelves of mass merchandising retailers, and additionally, the packages meet the size and weight limitations of parcel delivery service to allow home delivery of the furniture.

Accommodating various consumer decorating tastes by having a variety of interchangeable, fitted upholstery covering fabrics for the furniture is another advantage associated with the present invention. The upholstery covers are custom selected by the consumer, and can be also sold separately alongside the package containing the article of furniture. Further, the upholstery covers may be returned separately from the other components if the customer desires a different covering. Also, individual pieces of the upholstered covering, if damaged or stained for example, may be selectively ordered by the consumer and shipped to the consumer for replacement.

The ease of transportation of the compact kits by merchants or carriers reduces shipping costs and/or labor. Further, the compact nature of the kits allows consumers the option of either receiving home delivery of the furniture by a parcel delivery service, or to easily take the furniture home from a retail location at the time of sale in their own vehicles, rather than requiring them to wait for much later delivery by the retailer.

Conventional, pre-assembled upholstered furniture can be generally classified as having high quality and high cost, or low quality and low cost. The present invention provides ready-to-assemble upholstered furniture of high quality and low cost. In addition, the above advantages enable the novel approach to the sale of fully upholstered furniture involving the custom ordering of furniture by a consumer over an internet website for quick home delivery by a parcel delivery service.

In one embodiment, an article of furniture is provided, including a frame having a plurality of planar frame members; one of said frame members including a recess; and a connector element disposed in the recess, the connector element adapted to receive a fastener for interconnecting the frame members.

In another embodiment, an article of furniture is provided including a frame having a plurality of planar frame members, the frame including a seat back panel and an arm panel; and an upholstery cover covering the frame, including a seat back cover slidably disposed over the seat back panel, and an arm cover slidably disposed over the arm panel.

In a further embodiment, a method of packaging a ready-to-assemble article of furniture is provided, including providing an unassembled frame including a plurality of planar frame members; packaging the frame members in a first container; providing a padding element adapted to form a cushion for the article of furniture; packaging the padding element in a second container; providing an upholstery cover adapted to attach to the frame; and packaging the upholstery cover in a third container.

A still further embodiment provides a method of assembling a ready-to-assemble article of furniture, including providing a disassembled frame including a plurality of planar frame members, the frame members including interlocking portions, recesses and apertures; a plurality of push-in connector elements; and a plurality of fasteners; pushing the connector elements in the recesses; connecting the interlocking portions of the frame members; and securing the frame members by inserting the fasteners through the apertures and into the connector elements.

In another embodiment, the present invention provides a method of packaging disassembled upholstered furniture by disposing individual frame members, reduced volume padding and the requisite fasteners into a kit which can be easily shipped, stored, displayed on retail shelves, and transported by the consumer. This embodiment contemplates a variety of fitted covers separately available alongside the kit containing the disassembled furniture.

In another embodiment, the present invention provides an article of upholstered furniture assembled from the components which are disposed in the above-described kit via the present invention method.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
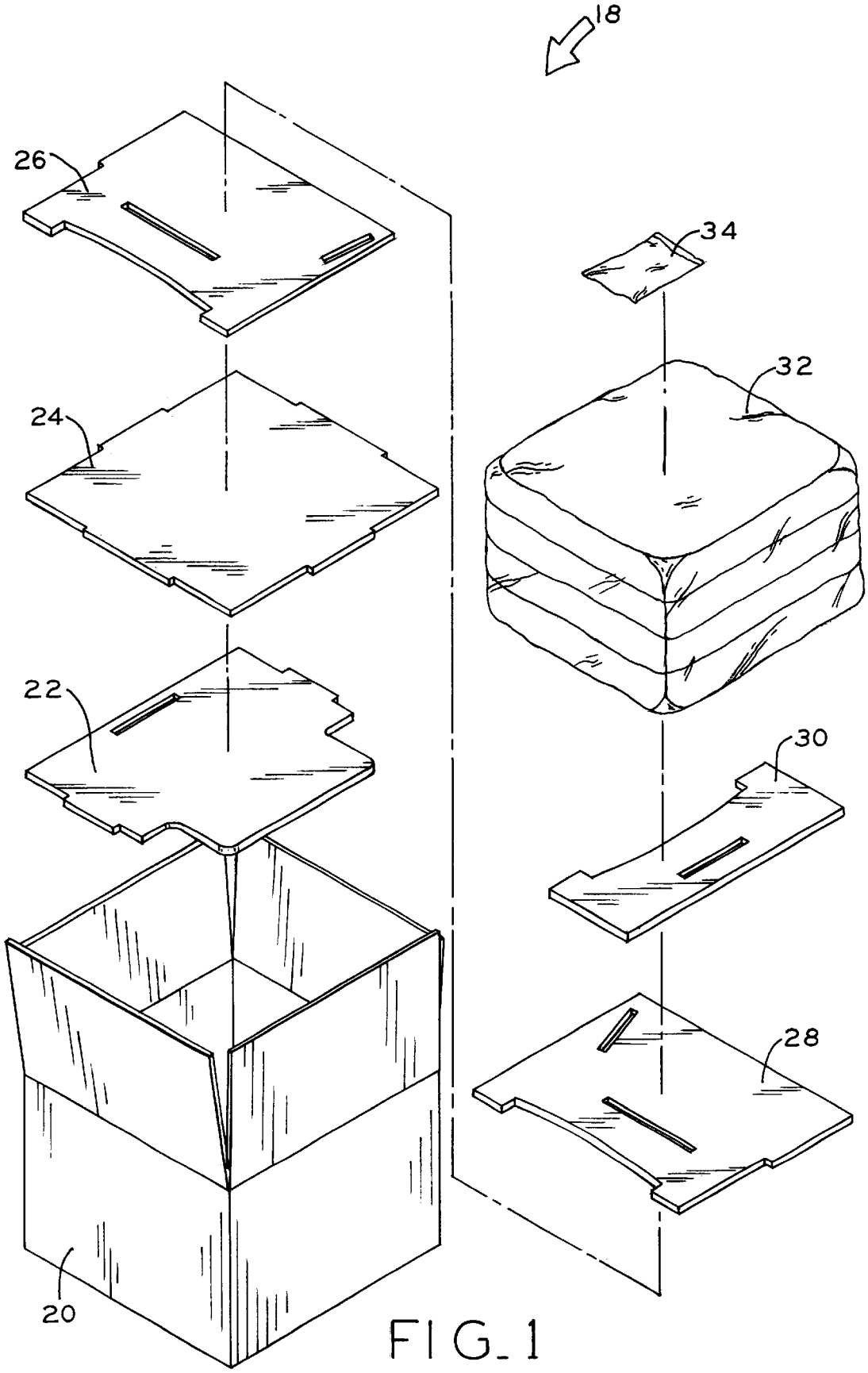
FIG. 1 is an exploded view illustrating the contents of one embodiment of the kit of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in alternative forms, and such exemplifications are not to be construed as limiting the scope of the invention in any manner.

DETAILED DESCRIPTION

The embodiments disclosed below are not intended to be exhaustive or limit the invention to the precise forms disclosed in the following detailed description. Rather, the embodiments are chosen and described so that others skilled in the art may utilize its teachings.

Figure 21:
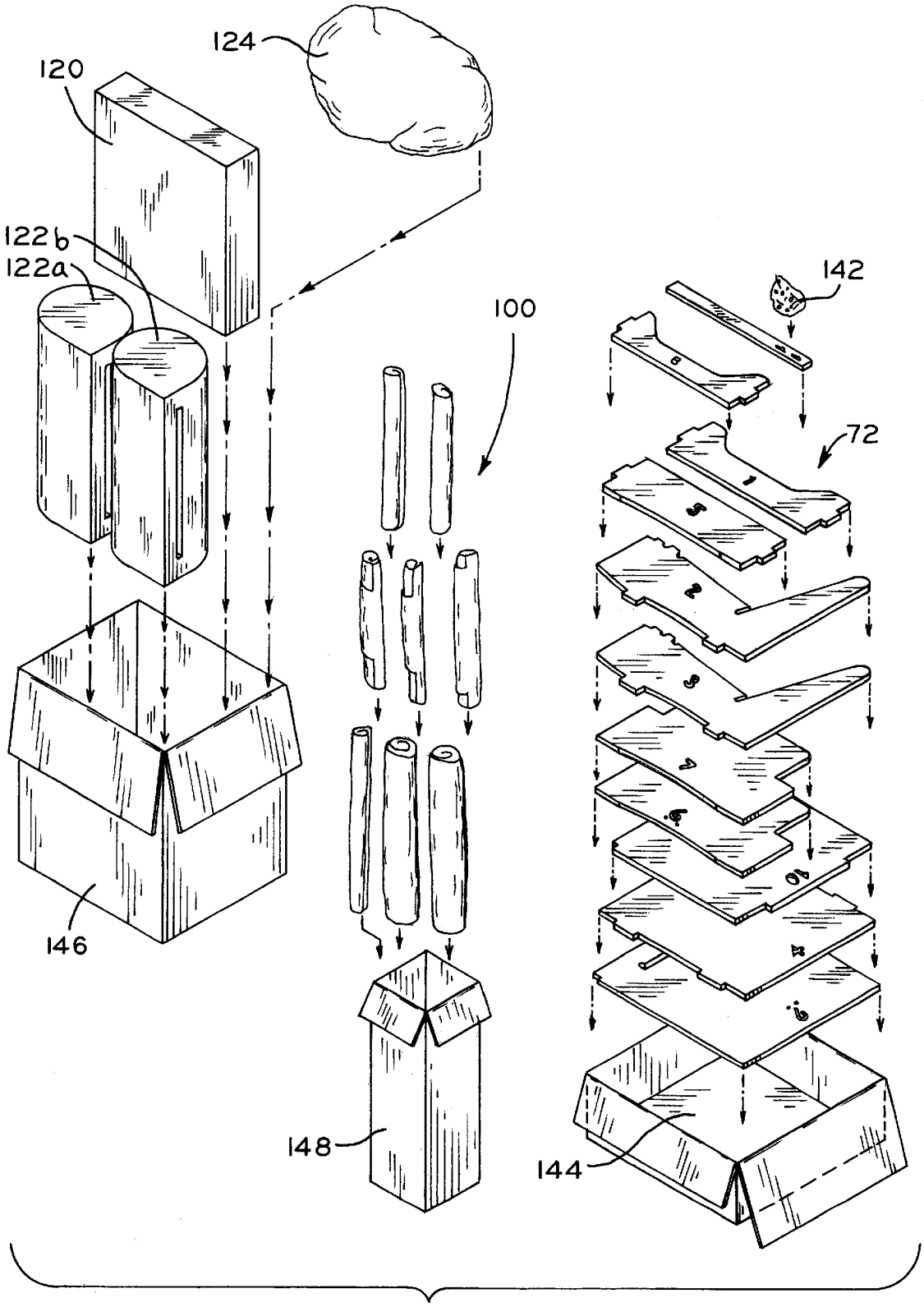
FIG. 21 is a schematic view of a method of packaging the disassembled article of furniture of FIG. 20.

Referring now to the drawings and particularly to FIG. 1, kit 33 having all necessary frame members 22–30, padding 32 in the form of vacuum-packed foam cushions and package 34 containing any required fasteners for the frame or assembly instructions is packaged into carton 31 or other suitable container of appropriate size. In one embodiment of the present invention, individual frame members 22–30 are individually wrapped in paper or other suitable material (not shown) to prevent scratches, and are then stacked inside carton 31 in a compact, orderly manner. Reduced volume padding 32 is then placed inside carton 31 such that it substantially occupies the remaining volume of carton 31. Package 34 is envisioned to be rather small and is placed in whatever space then remains inside carton 31. In this manner, a piece of upholstered ready-to-assemble furniture which, when assembled, is comparable in size to a conventional, pre-assembled piece of furniture, may be compactly packaged. Alternatively, the disassembled frame and the reduced volume padding comprising the kit may be packaged in separate cartons in cases of the volume requirements of each being such as to make inefficient the use of a single carton as shown in FIG. 21, and described below.

The number, size and shape of frame members 22–30 will vary depending on the article of furniture to be produced from the kit of the present invention, but in all embodiments, the frame members are a suitable supporting material, such as pre-finished plywood. Alternative frame member embodiments using materials such as solid wooden boards, laminated particle board, preformed plastic or metal pieces, varieties of fiberboard or strandboard, structural cardboard or honeycombed paperboard. Further, fasteners may not be required for interconnecting the frame members. For example, frame assembly may instead consist of interconnecting frame members which include slots allowing their mutual engagement, or adhesives may be used to join the frame members. Still further, that frame members may or may not be pre-finished. For example, the frame members may consist of unfinished wooded pieces that the consumers may stain and varnish or paint to suit their individual tastes.

One frame 70, corresponding to an embodiment further described below, is, shown in FIG. 16. Frame 70 includes a plurality of individual frame members.72 which are assembled together to form frame 70. Frame members 72 are planar sheets or panels, and may be made of medium density fiberboard ("MDF"). MDF is made from fibers of various types of wood which are refined and pressed to form lightweight fiberboard sheets having a strong outer surface which can be finished with most commercial finishing materials such as sealer, varnish, or paint. MDF is available in sheets which may range from ⅜" thick to 1½" thick, for example, and the length and width of MDF sheets may vary widely depending upon the supplier. One such MDF material is ½" GP Superior, available from Georgia-Pacific Co., and manufactured at their Sault Ste. Marie plant in Ontario, Canada. However, MDF is generally widely available from many commercial suppliers.

Frame members 72 may be cut from large sheets of MDF using widely-available machinery such as computer-controlled cutting saws and routers, for example. As shown in FIG. 16, frame members 72 generally include base panel 72*a*, interior side panels 72*b*, 72*c*, arm panels 72*d*, 72*e*, front panel 72*f*, back panel 72*g*, seat back panel 72*h*, seat back support panel 72*i*, storage compartment lid panel 72*j*, and insert 72*k*. Storage compartment lid panel 72*j* includes handle cutout 74 and tongue 76, which is slidingly fitted within slot 78 of seat back panel 72*h* to provide a hinged connection therebetween.

Frame members 72 also include projections 80 and cutout portions 82, which are insertable into one another to connect adjacent frame members 72. As shown in FIG. 16, cutout portions 82 may include slots 82*a* and apertures 82*b*. For securing adjacent frame members 72, recesses 83 are provided, which are adapted to receive push-in connector elements 84. In addition, apertures 86 are provided, which receive fasteners 88 cooperating with push-in connector elements 84, as described below with reference to FIG. 16A. As shown in FIG. 16, it may be seen that each frame member 72 includes a number cutout 90, with frame members 72*a*–72*k* numbered 1–11, respectively, to define a sequentially numbered set of frame members 72 comprising frame 70. Advantageously, this numbering of frame members 72 eases assembly of frame 70 by allowing individual frame numbers 72 to be identified and referred to in a set of printed assembly instructions, for example.

Figure 16:
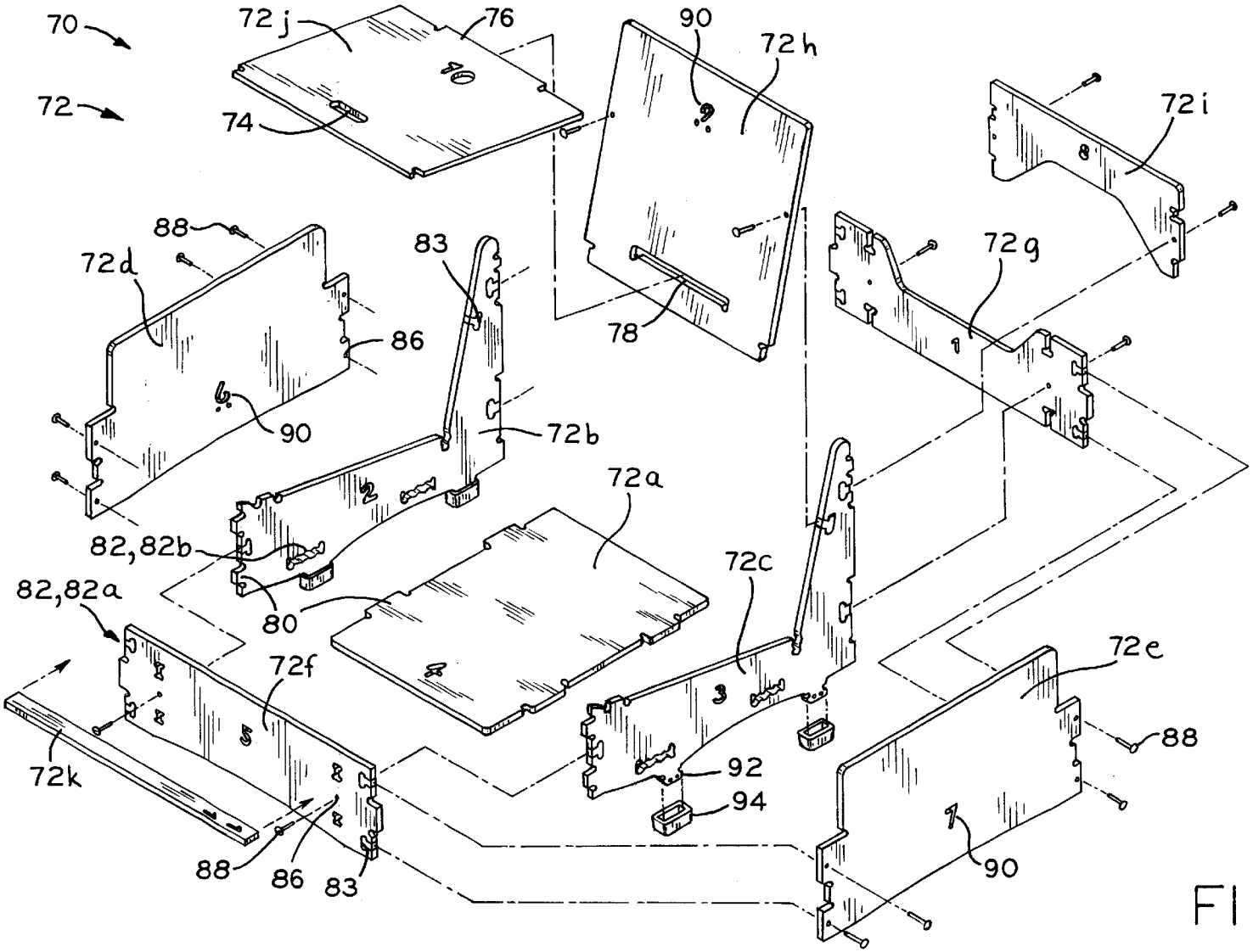
FIG. 16 is an exploded view of the frame of a fifth embodiment of an article of furniture.

Additionally, some frame members 72, such as interior side panels 72*b*, 72*c* as shown in FIG. 16, may include feet 92, each covered by foot cap 94 which is pressed onto to each foot 92. Foot caps 94 engage a floor surface to prevent frame 70 from sliding thereon, and to prevent frame 70 from scratching the floor surface. Foot caps 94 also serve as a protective "boot" to protect feet 92 from water or moisture, and to protect feet 92 from contact with other objects which may cause feet 92 to dent, flake, or delaminate.

Figure 16A:
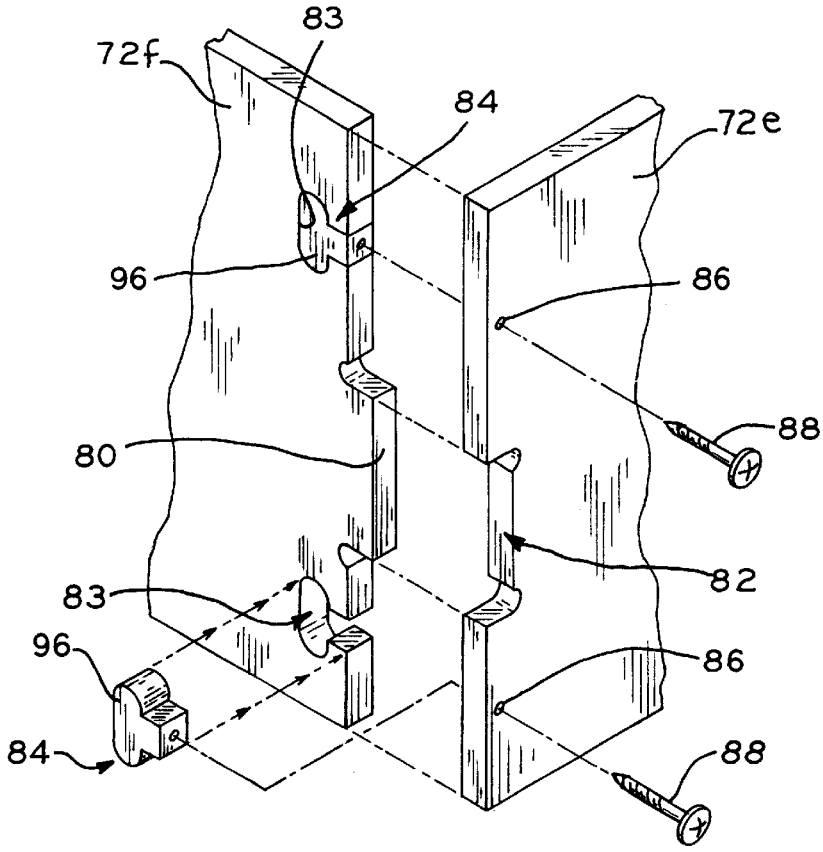
FIG. 16A is a fragmentary view of a portion of the frame of FIG. 16, showing the attachment of individual adjacent frame members.

FIG. 16A illustrates one method of attaching and securing adjacent frame members 72 to form frame 70. For example, projection 80 of front panel 72*f* is received within cutout portion 82 of arm panel 72*e* to interlockingly connect front panel 72*f* with arm panel 72*e*. To secure adjacent frame members 72, such as front panel 72*f* and arm panel 72*e*, push-in connector elements 84, which may be formed of any suitable plastic, for example, are pushed into recesses 83 provided in front panel 72*f*. Fasteners 88 may then be threaded through apertures 86 in arm panel 72*e*, which are then received in push-in connector elements 84 within front panel 72*f*. Push-in connector elements 84 act as screw sets for fasteners 88, and also include oblong portions 96 disposed in recesses 83 to prohibit separation of adjacent frame members 72.

Figure 17:
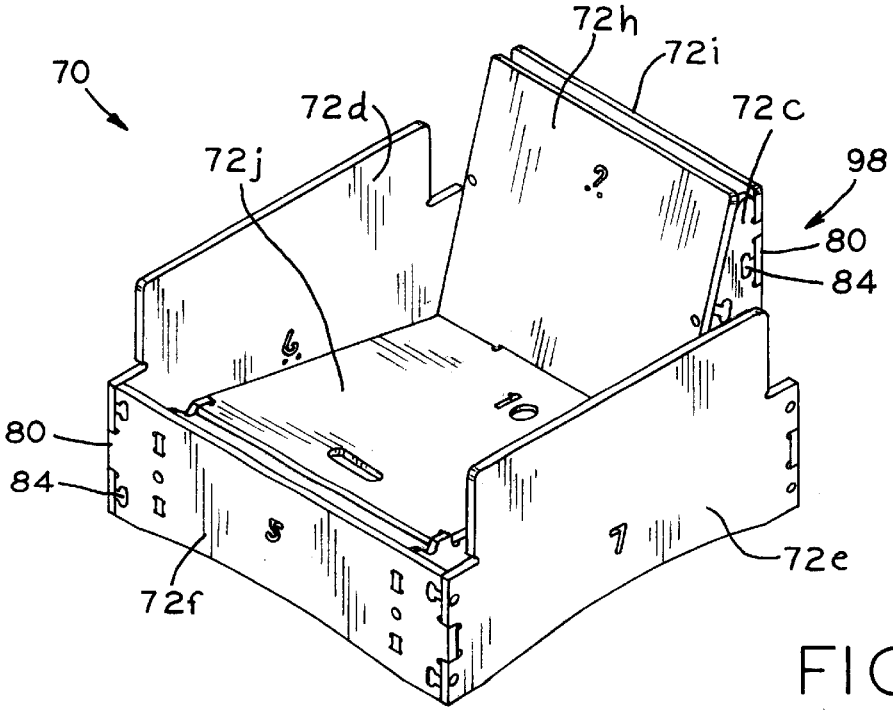
FIG. 17 is a perspective view of the assembled frame of FIG. 16.

Frame 70 is shown assembled in FIG. 17, where frame 70 is for an exemplary chair 98. Assembly of chair 98 is completed by attaching upholstery covers 100 and cushions 102 thereto, as described below. However, many articles of fully upholstered furniture may be made other than chair 98 using the teachings herein, such as loveseats, couches, ottomans, sofabeds, or daybeds, among others.

Individual padding elements appropriate to the article of furniture to be produced from kit 33 are reduced in volume, such as by being vacuum-packed or by being compressed between plates, or by a combination of these methods, into compressed form which greatly reduces the volume otherwise necessary to package kit 33. The padding should be reduced by approximately two thirds (⅔) from its original, expanded size to properly practice one embodiment of the present invention, but further reduction is desirable and the amount of volume reduction achievable may vary by padding material. By the above-mentioned volume reduction methods, the volume of urethane foam padding, for example, can be reduced to approximately one sixth (⅙) of its natural, expanded size. Although the padding elements may be made from urethane foam, Dacron or any other suitable, compressible materials may be used. Further, different materials may be used for different cushions. For example, in a given article of furniture the seat cushion(s) may be made of urethane foam, while the back and/or arm cushions may be made of Dacron.

The amount of compression foam padding undergoes affects its ability to subsequently expand to its original size. For example, inexperiments in which a 12 inch cubic block of urethane foam material having an indentation load deflection (ILD) rating of 35 (i.e., 35 pounds of force is required to deflect the foam by 25 percent) and a density of 1.5 pounds per cubic foot was compressed into a 12 inch square slab 1.5 inches thick, the material expanded to 96 percent of its original Volume after 24 hours. Further expansion beyond that time was negligible. In an otherwise identical experiment using urethane foam having a density of 1.2 pounds per cubic foot, the material expanded to 90 percent of its original volume. Compression to a lesser extent would have resulted in each of these samples expanding more nearly to its original volume. Furthermore, where heavy compression takes place in a high humidity environment, plastic deformation in the shape of the expanded urethane foam cushions may result. Therefore, it should be noted that to ensure the foam expands properly to its final shape and size, its compression should take place in a low humidity environment.

Furthermore, compression of the foam material adversely affects its quality. For example, the 1.5 pound per cubic foot urethane foam block subjected to the above described compression test incurred a 2 pound degradation in its ILD rating, dropping from 35 to 33. The 1.2 pound per cubic foot sample had its ILD drop from 35 to 28 under the same conditions. Thus it can be seen that a denser urethane foam better retains its load bearing capability after compression than its lighter weight counterpart. Compression to a lesser extent would have resulted in each of these samples exhibiting a less pronounced degradation in its ILD rating. This degradation in quality manifests itself primarily through reduced longevity of the padding's resilience, and does not necessarily affect the initial comfort it provides.

For urethane foams of a given ILD rating and chemical composition, a denser foam costs more than a lighter weight foam. From the foregoing it can then be understood that, because the cushions' post-expansion sizes, upon which the proportions of the finished article of furniture are determined, and longevity are dependent on their original densities and the extent to which they are compressed, there are tradeoffs to be made between their cost, quality and package. Also, it must be emphasized that the intended post-expansion size of each cushion and its desired life are factors which must be considered in developing the component padding elements of the present invention.

Figure 2:
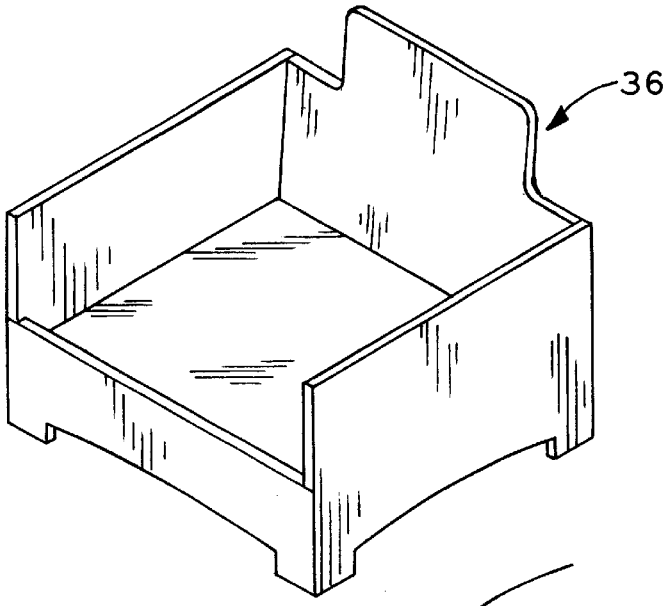
FIG. 2 is a perspective view of the frame of one embodiment produced from the present invention kit.
Figure 3:
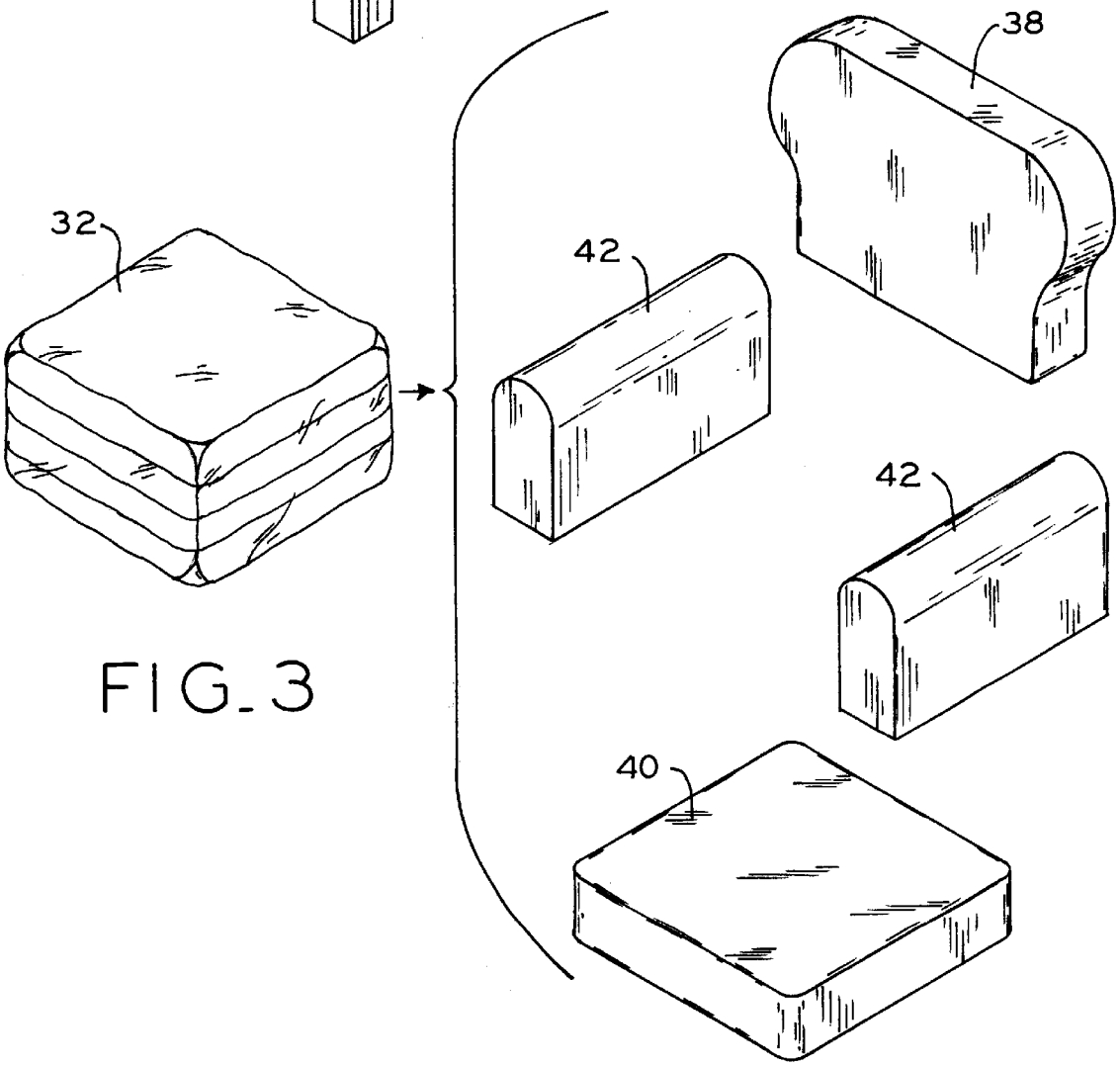
FIG. 3 is a view showing the vacuum-packaged foam pieces of one embodiment of the present invention in their compressed and expanded states.

As the compressed padding elements are unpackaged and allowed to expand, each will take on a size and shape appropriate to upholster frame 36 (FIG. 2). For example, the embodiment of kit 33 contains vacuum-packed foam pieces for padding 32 which, when unpackaged and allowed to expand to their approximate original sizes and shapes, will provide back cushion 38, seat cushion 40 and two arm cushions 42 (FIG. 3).

One embodiment of the present invention contemplates having each cushion covered by a porous, protective cover (not shown) made of a material such as muslin or denim, which may or may not be decorative, prior to the cushion's volume being reduced. Each piece of reduced volume padding in the kit would include such a protective cover. The porosity of the protective cover allows air to exit the cushion during the reduction of the cushion's volume, prior to its being packaged, and to enter the cushion during its expansion, upon unpacking it. The porous protective cover would be fitted to envelop the cushion and be permanently sewn closed or closed thereon with a fastener. Fasteners appropriate for closing the protective cover include, for example, zippers or hook and loop fasteners. As the cushions are expanded during final assembly of the article of furniture, the protective cover would remain on the cushion and may subsequently be covered by the separately provided decorative fabric covers as described below. Further, where foam padding is used, the protective cover will make installation of the decorative fabric covers easier due to the protective cover's surface having a lower coefficient of friction vis-a-vis the surface of the uncovered foam. Installation of the decorative covers will also be made easier where a protective cover is used over padding material having a loose, fibrous composition, such as Dacron. Further still, the protective, cover provides the additional advantages of retaining any cushion material debris which accumulates due to normal padding wear or due to fragmentation of loose, fibrous padding material.

Figure 9:
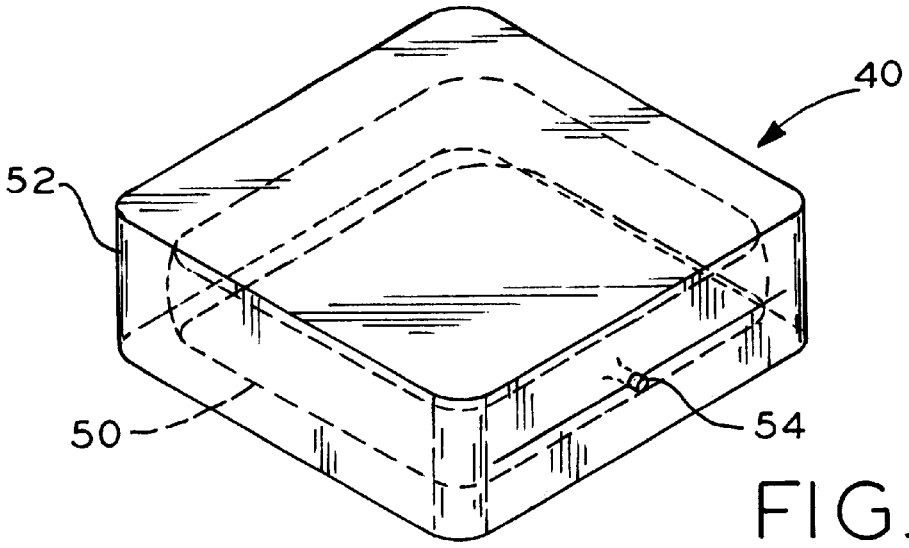
FIG. 9 is a perspective view of a third embodiment of a cushion for an article of furniture provided by the present invention.
Figure 10:
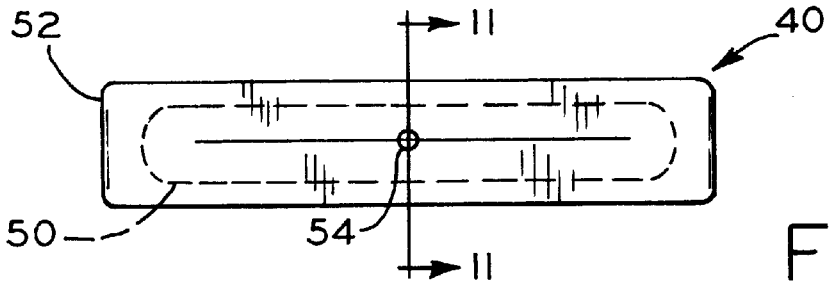
FIG. 10 is a side view of the cushion of FIG. 9.
Figure 11:
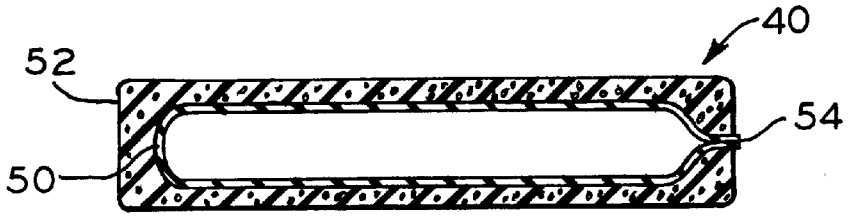
FIG. 11 is a sectional view of the cushion of FIG. 10 along line 11—11.
Figure 12:
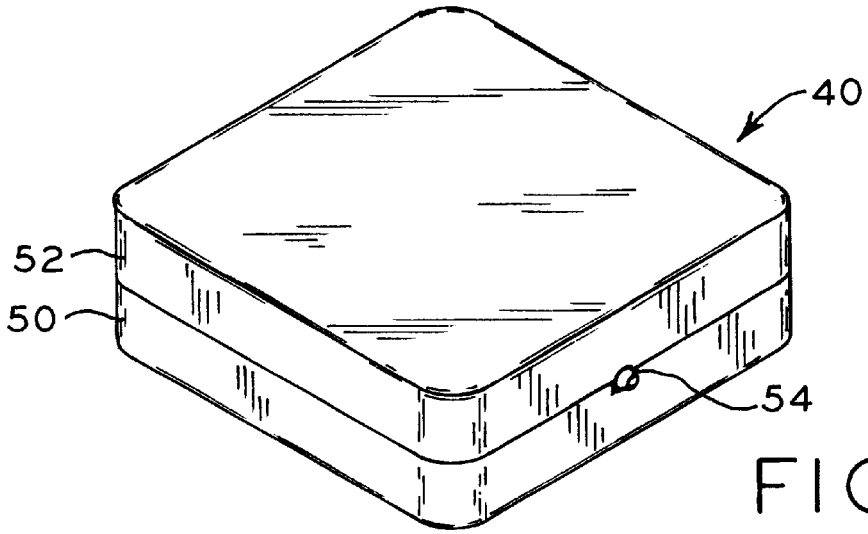
FIG. 12 is a perspective view of a second embodiment of a cushion for an article of furniture provided by the present invention.
Figure 13:
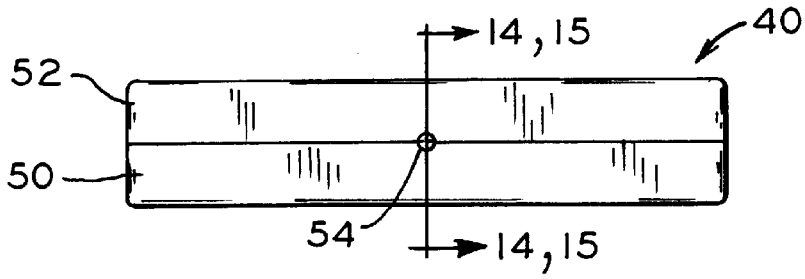
FIG. 13 is a side view of the cushion of FIG. 12.
Figure 14:
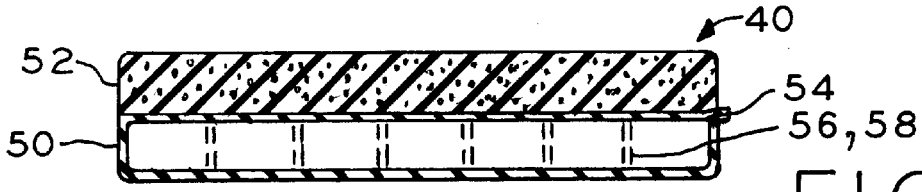
FIG. 14 is a sectional view of the cushion of FIG. 13 along line 14/15—14/15.
Figure 15:
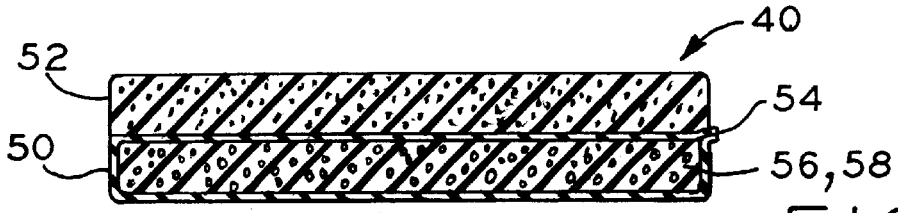
FIG. 15 is an alternative sectional view of the cushion of FIG. 13 along line 14/15—14/15.

Another aspect of the present invention, exemplified in the figures as relating to seat cushion 40 although it is applicable to each cushion, contemplates cushions having flexible bladder 50 (FIGS. 9 and 12) made of a material such as rubber, for example. As shown in FIGS. 9–11, padding material 52 corresponding to seat cushion 40 may envelop the bladder or, as shown in FIGS. 12–15, padding material 52 may be adhered to a only portion of the surface of bladder 50. Bladder 50 is evacuated while the cushion is packaged, and filled with a fluid such as air or water through closeable valve 54 during final assembly of the article of furniture. Bladder 50 may include baffles 56 to dampen the movement of the fluid. Baffles 56 may be of a type which includes staggered or perforated walls 58 attached to the inside surfaces of bladder 50 (FIG. 14) or a of a type which uses a porous filler 60 which is more compressible than the padding material, such as open cell foam, disposed within bladder 50 (FIG. 15). One advantage provided by this embodiment is the further reduction in the package volume required to provide an article of ready-to-assemble upholstered furniture compared to reducing the volume of the padding alone, as described above. Further, adjusting the quantity of fluid in the bladder may accommodate varying comfort levels of the consumers. A cushion having such a bladder may also be used in conjunction with the protective cover described above. During final assembly of the article of furniture, cushions having the fluid-filled bladder may be covered by the separately provided decorative fabric covers as described below.

Accommodating a variety of consumer tastes without requiring excessive warehouse or shelf space is an object of the present invention. Therefore, it will be noted that kit 33 contained in carton 31, which includes frame members 22–30 and reduced volume padding 32, assembles-to produce an unupholstered article of furniture. Finished fabric covers to fit each individual padding element, or matching sets thereof to outfit an entire article of furniture, are packaged and can be made available separately for use with kit 33 contained in carton 31. In this way, a stock of kits can be conveniently warehoused or displayed at retail facilities which, when purchased with one of several different and separately available fabrics, can accommodate a variety of decorating tastes.

Figure 4:
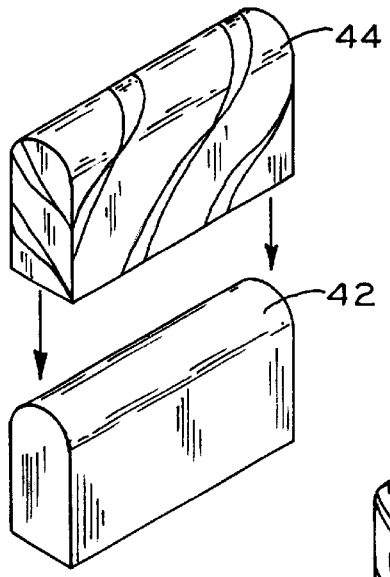
FIG. 4 is a perspective view of the fitted fabric covering for one of the foam pieces of one embodiment of the present invention.

The separately available fabric covers, designed to fit over the expanded padding elements from kit 33, are installed by the consumer. Referring to FIG. 4, a fabric covering 44 is fitted over a foam arm cushion 42 to form an upholstered piece. Similarly, each foam piece is covered by a corresponding fabric cover. Alternatively, a fabric cover may be fashioned to cover more than one padded element. For instance, a single decorative cover may be designed to accommodate the three back cushions for a sofa.

The fabric covers may be secured around the foam pieces by zippers, hook and loop fasteners, adhesives or by merely folding excess material of the fabric under the foam piece itself or into the slotted portion 48 (FIG. 5) of the foam piece, resulting in an upholstered piece 46. The entire padded portion may be covered by fabric, or only the portion that would be visible upon final assembly of the furniture. Notably, the fabrics are interchangeable. The method of making available fabric covering sets separate from kit 33 in a wide variety of patterns and colors allows consumers to easily replace the fabric for repair or redecoration.

Figure 5:
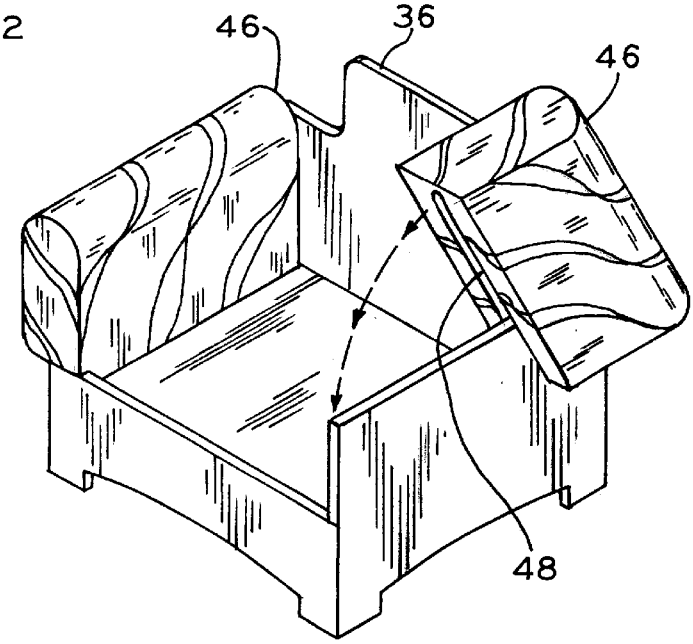
FIG. 5 is a view showing assembly of an upholstered piece to the frame of one embodiment of an article of furniture produced from the present invention kit.

Once the fabric is applied, each upholstered piece is applied to the frame 36. As shown in FIG. 5, some upholstered pieces 46 are fitted over portions of frame 36 shaped to be slidedly received within their slotted portions 48. Other upholstered pieces, such as the seat portion, may be applied to the frame without such engagement. Alternatively, the padded elements are assembled to the frame without fabric covers. In this embodiment, the covers are later installed and are appropriately designed to cover a portion of the frame as well as the cushion. Tape with adhesive on both sides may be used in this embodiment. One side of the tape may be permanently adhered to the frame with the decorative cover, which has been drawn over a cushion, detachably adhered to the other side of the tape. Furthermore, other embodiments may use fabric covers designed to fit over some portions of the frame in lieu of padding. Further still, fabric covers may be used to cover portions of the frame surface which would otherwise be exposed and hard finished.

Figure 18:
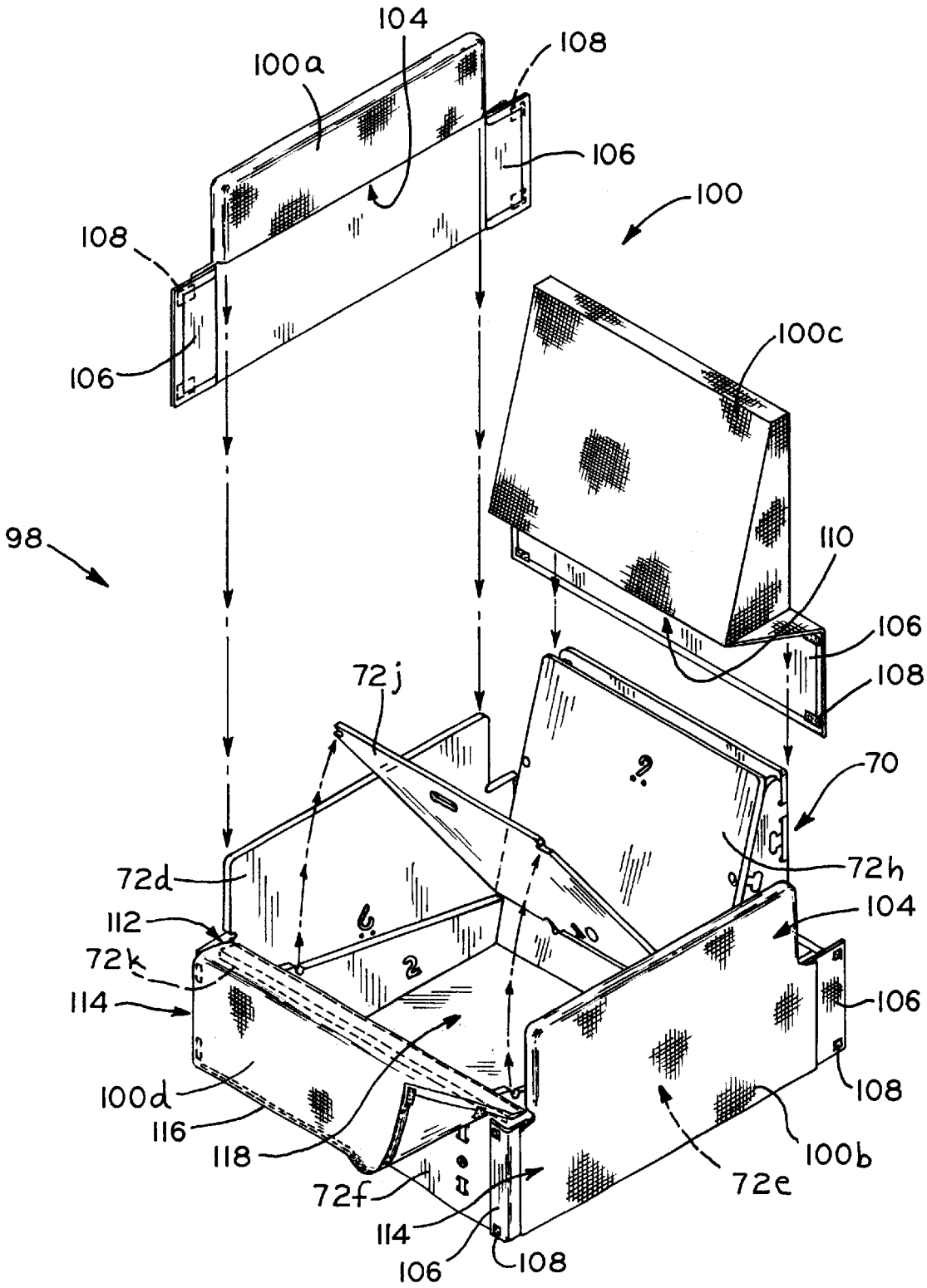
FIG. 18 is a perspective view of the fifth embodiment of an article of furniture, showing the attachment of upholstery covers to the frame of FIG. 17.

For example, a first set of upholstery covers 100 may be attached to frame 70, described in FIGS. 16, 16A and 17, as shown in FIG. 18. Upholstery covers 100 may include arm covers 100*a*, 100*b*, seat back cover 100*c*, and front cover 100*d*. Arm covers 100*a*, 100*b* include arm pockets 104, and flaps 106 having hook and loop fasteners 108 thereon. As shown in FIG. 18, arm covers 100*a*, 100*b* are slid onto arm panels 72*d*, 72*e* of frame 70, such that arm panels 72*d*, 72*e* are received within arm pockets 104. Similarly, seat back cover 100*c* includes seat back pocket 110 and flaps 106, and is slid onto seat back panel 72*g* of frame 70, such that seat back panel 72*g* is received within seat back pocket 110. Front cover 100*d* includes insert pocket 112 having insert 72*k* therein, which is draped over front panel 72*f* of frame 70 to hold front cover 100*d* in place.

The lower portions of arm covers 100*a*, 100*b* seat back cover 100*c*, as well as front cover 100*d* each include flaps 106 having hook and loop fasteners 108 which overlap and fasten to one another to define skirt 114 around the lower portion of chair 98. Skirt 114 has a clean, stitched appearance which appears identical to the stitched skirt seen on conventional furniture. The lower portions of arm covers 100*a*, 100*b*, seat back cover 100*c*, as well as front cover 100*d* each further include a weighted beading 116 stitched therein to provide a decorative finish for skirt 114 and to maintain skirt 114 flat around the lower portion of chair 98. As shown in FIG. 18, storage compartment lid panel 72*j* is hingedly attached to seat back panel 72*h*, and may be lifted for selective access to storage compartment 118 within frame 70.

Figure 19:
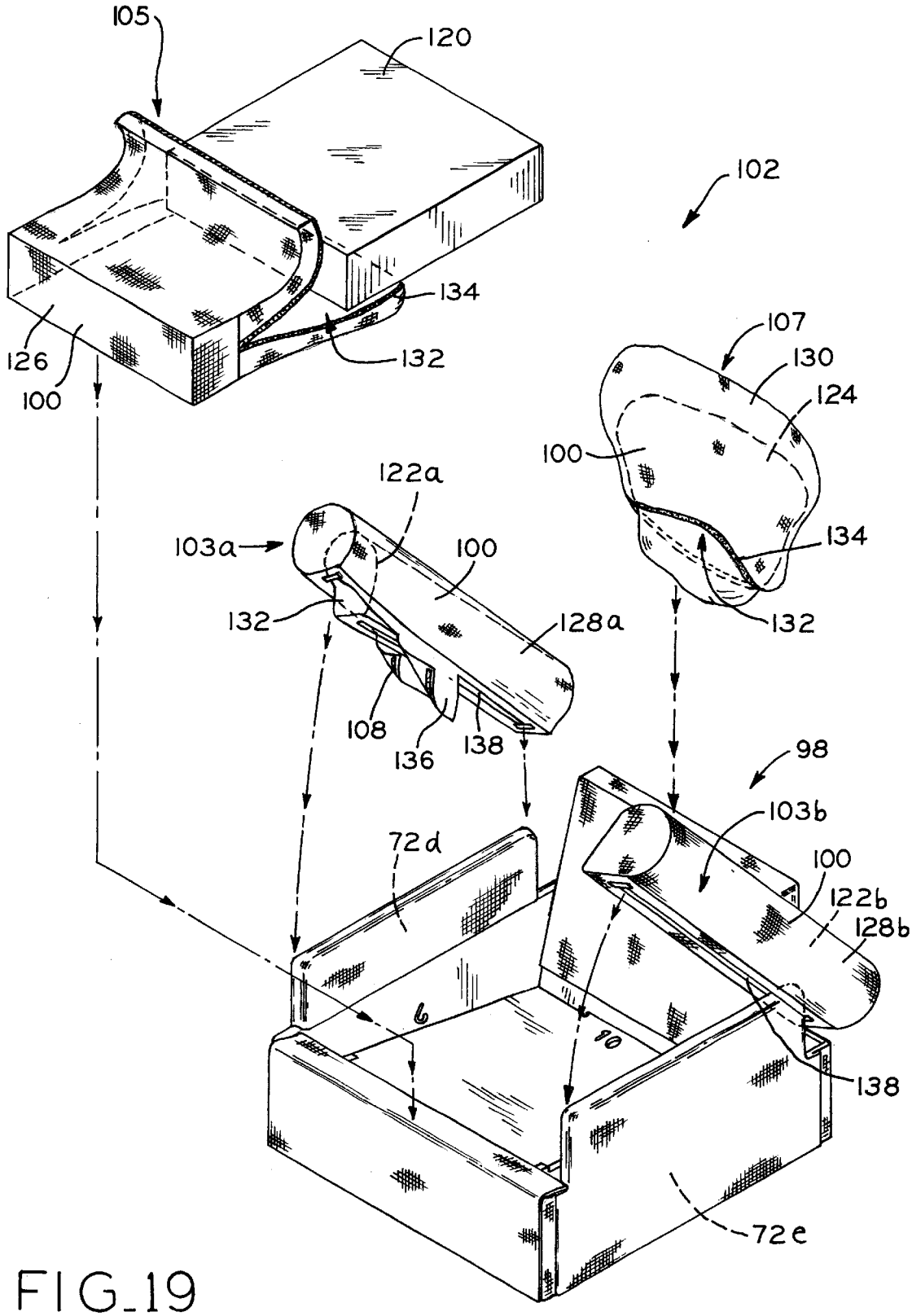
FIG. 19 is a perspective view of the fifth embodiment of an article of furniture, showing the assembly of cushions therefor.

FIG. 19 illustrates the assembly of cushions 102 for chair 98. Seat padding 120, and arm pads 122*a*, 122*b*, are foam elements, while seat back padding 124 is a pillow. Seat padding 120, arm pads 122*a*, 122*b*, and seat back padding 124 are covered by a second set of upholstery covers 100, including seat cover 126, arm covers 128*a*, 128*b*, and seat back cover 130 to form seat cushion 105, arm cushions 103*a*, 103*b*, and seat back cushion 107, respectively. As shown in FIG. 19, seat padding 120 is inserted within seat cover 126, which includes a large opening 132 to ease insertion of seat padding 120 therein. Seat cover 126 additionally includes fasteners 134 such as hook and loop fasteners or a zipper fastener to close seat cover 126 around seat padding 120 to form seat cushion 105. Seat cushion 105 is then placed on storage compartment lid 72*j* to form a seat for chair 98. Similarly, seat back padding 124 is inserted into seat back cover 130 which also includes a large opening 132 and fasteners 134 to close seat back cover 130 around seat back padding 124. Seat back cushion 107 is then placed on seat cushion 105 adjacent seat back panel 72*h* of chair 98.

Arm pads 122*a*, 122*b* are inserted into arm covers 128*a*, 128*b*, which additionally include large opening 132. Flaps 136 of arm covers 128*a*, 128*b* are attached to one another by hook and loop fasteners 108 and then stuffed into envelope slits 138 of arm pads 122*a*, 122*b* to form arm cushions 103*a*, 103*b*. Arm cushions 103*a*, 103*b* are then mounted onto arm panels 72*d*, 72*e* such that arm panels are received within envelope slits 138 of arm cushions 103*a*, 103*b*.

Figure 20:
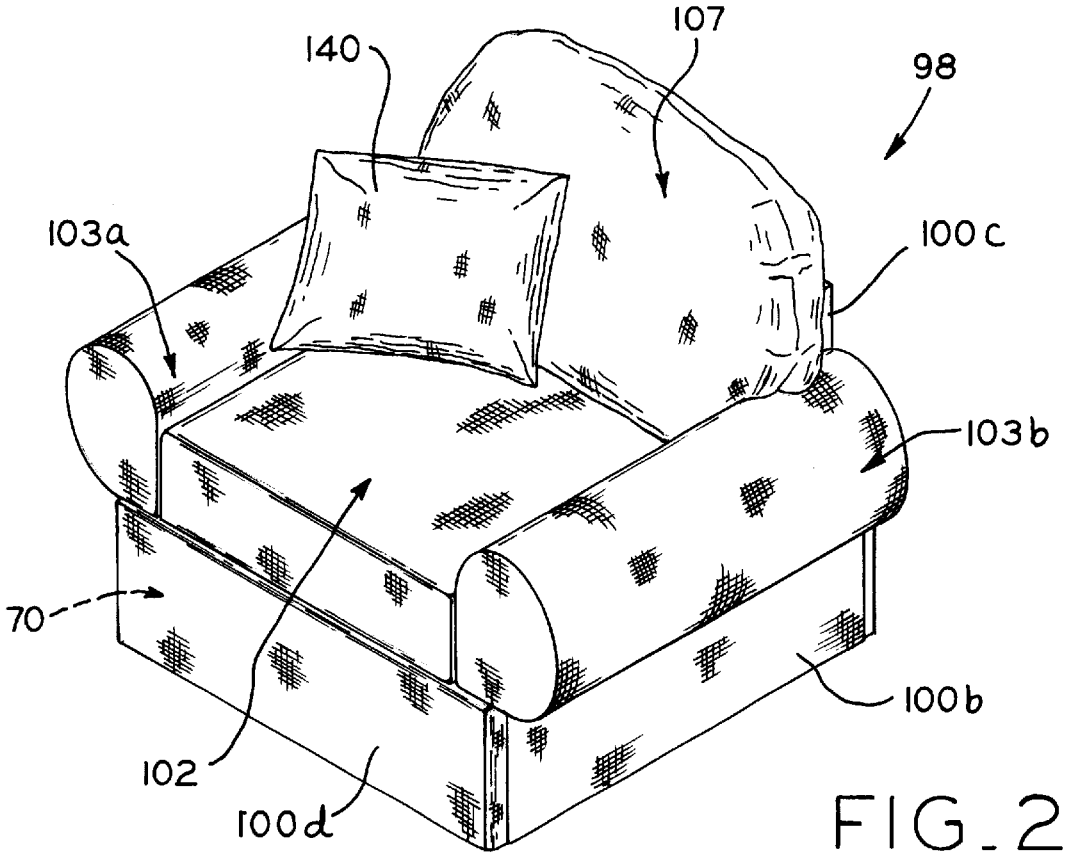
FIG. 20 is a perspective view of an assembled article of furniture of the fifth embodiment.

FIG. 20 is a view of an assembled chair 98, including seat cushion 102, seat back cushion 107, and arm cushions 103*a*, 103*b* disposed on frame 70, which is covered by seat back cover 100*c*, arm covers 100*a* (not shown), 100*b*, and front cover 100*d*. It may be seen from FIG. 20 that chair is fully upholstered, such that no portion of frame 70 is visible. Optionally, a decorative pillow 140 may be included with chair 98, corresponding to a design selected by the consumer. Additionally, chair 98 may be disassembled for transportation or storage in the opposite manner of the assembly of chair 98 shown in FIGS. 16–20.

FIG. 21 illustrates one method of packaging an article of furniture such as chair 98 for shipment. Frame members 72, as well as push-in connector elements 84 and fasteners 88 disposed within bag 142, are packaged in a first container 144. Seat padding 120, arm pads 122*a*, 122*b*, and seat back padding 124 are packaged in second container 146, and upholstery covers 100 are packaged in a third container 148.

In this manner, chair 98 may be packaged in three separate containers 144, 146 and 148, each of which may weigh less than 70 lbs., for example, to allow containers 144, 146, and 148 to be shipped for home delivery by a parcel delivery service. In addition, the shipment of chair 98 in separate containers eases packaging, such that separate sets of custom selected designs of upholstery covers 100 may be shipped with standard frame members 72 and pads 120, 122*a*, 122*b*, and 124. Additionally, upholstery covers 100 may be easily returned, without necessitating the return of all of the components of chair 98, if found not suitable to the customer's liking or if later damaged.

Figure 6:
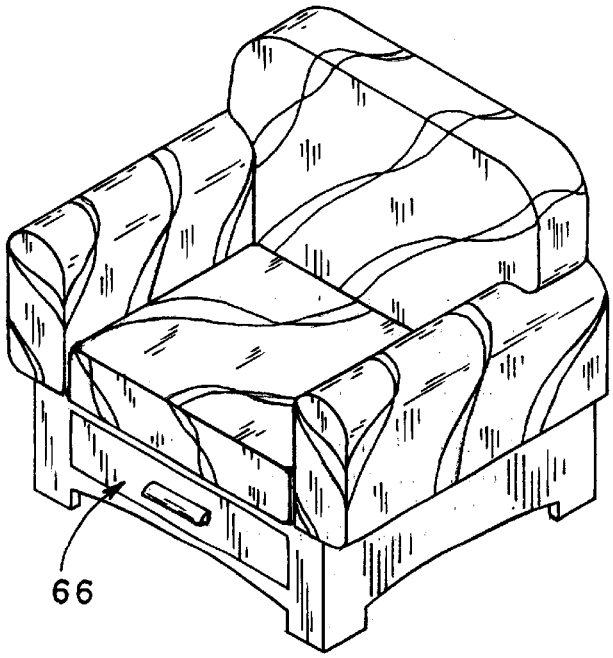
FIG. 6 is a perspective view of a second embodiment of an upholstered article of furniture produced from the present invention kit.
Figure 7:
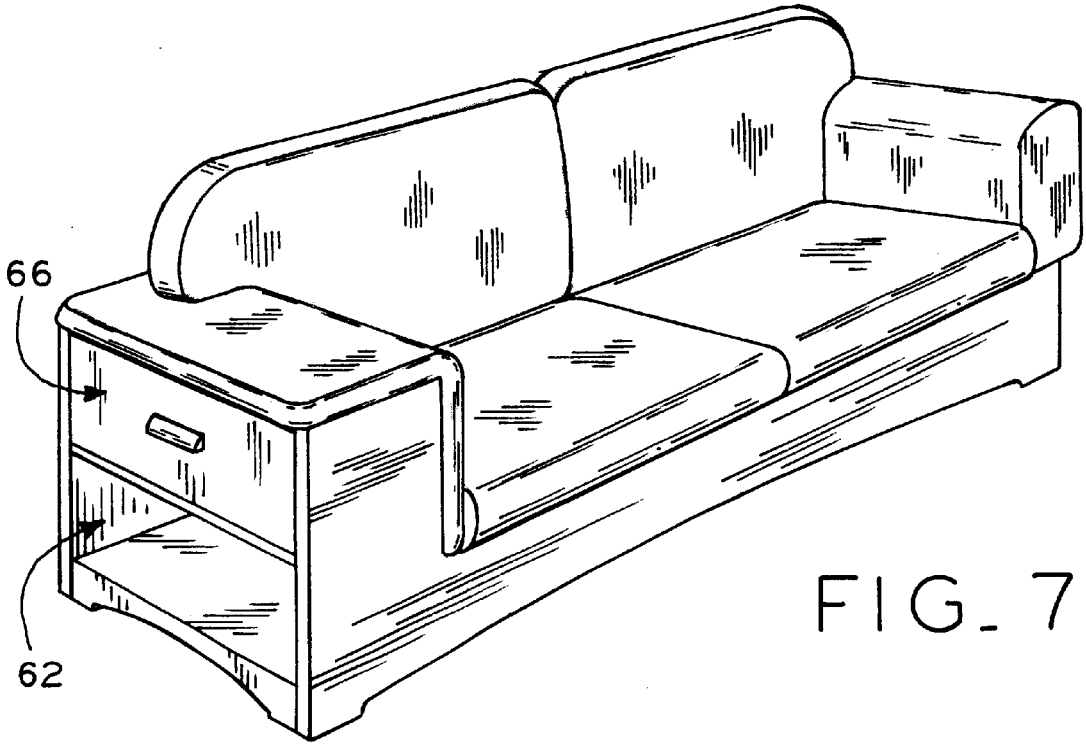
FIG. 7 is a perspective view of a third embodiment of an upholstered article of furniture produced from the present invention kit.
Figure 8:
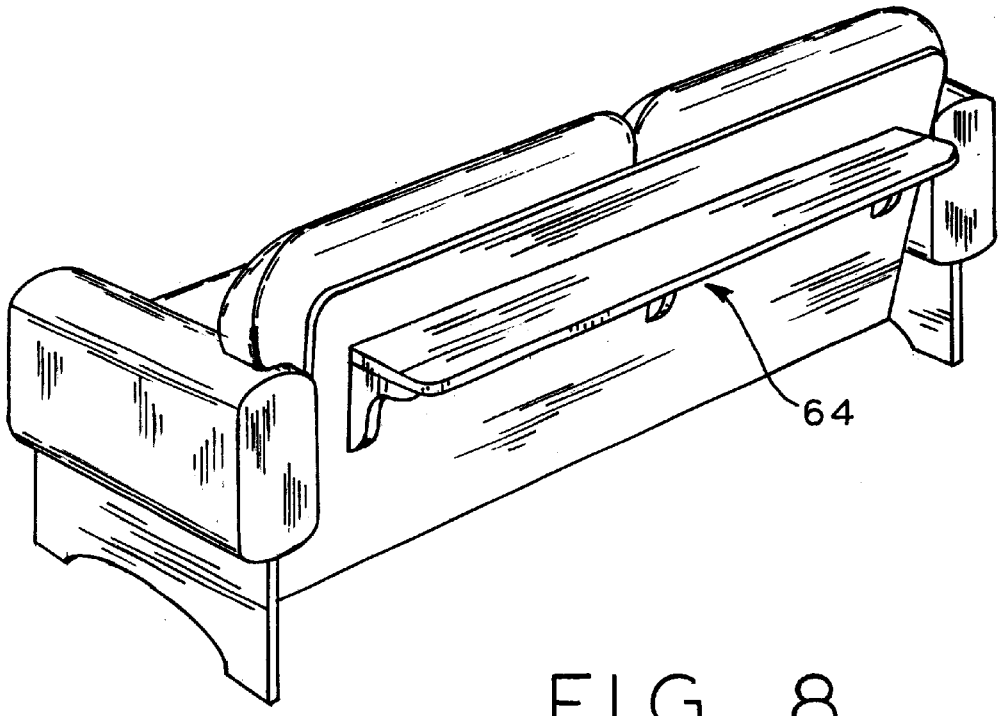
FIG. 8 is a perspective view of a third embodiment of an upholstered article of furniture produced from the present invention kit.

As shown in FIGS. 6–8, the article of upholstered furniture from the kit may take the form of, for example chairs or sofas. Furthermore, the article of furniture may also incorporate features such as drawer 66, as shown in FIGS. 6 and 7, bookcase 62, as shown in FIG. 7, or shelf 64, as shown in FIG. 8. In such embodiments, the components necessary to provide these features are packaged as and/or with frame members into the kit and incorporated as the frame is assembled. The embodiments shown in FIGS. 7 and 8 are only particular examples of this aspect of the present invention, and should not be construed as limiting its scope. Other embodiments incorporating features such as cup holders, magazine racks, television remote control holders and the like, and locating them in or on various surfaces of the frame, are also contemplated as being within the scope of the present invention.

As an example of the improved packaging efficiency of an upholstered ready-to-assemble article of furniture provided by the present invention vis-a-vis that which has been pre-assembled, an upholstered sofa measuring 85 inches long by 33 inches high by 33 inches deep (53.6 cubic feet) would, if pre-assembled, require a box of at least these dimensions, whereas by the present invention only a frame box 77 inches by 3.5 inches by 26.5 inches (4.1 cubic feet), a reduced volume padding box 34.5 inches by 10 inches by 29.5 inches (5.9 cubic feet) and a coverings box 4.75 inches by 33.5 inches by 22 inches (1.1 cubic feet) would be required.

While this invention has been described as having exemplary methods and designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of assembling a ready-to-assemble article of furniture, comprising:

providing; a disassembled frame, including a plurality of planar frame members, each said planar frame member including a plurality of edges and a pair of opposed planar surfaces, at least one of said frame members having a recess in its planar surface and at least one of said frame members having an aperture in its planar surface, said frame members including interlocking portions; a push-in connector element which is separate from the frame members; and at least one fastener;

interconnecting said interlocking portions;

inserting the connector element into said recess in a direction which is perpendicular to said planar surfaces; and securing said frame members by inserting said fastener through said aperture and into said connector element, said fastener oriented substantially perpendicularly to the insertion direction of said connector element.

2. The method of claim 1, wherein said frame members are made of medium density fiberboard.

3. The method of claim 1, further comprising:

applying an upholstery cover over the frame members, said upholstery cover including hook and loop fasteners.

4. The method of claim 3, further comprising:

providing a padding element and a second upholstery cover, said second upholstery cover including a relatively large opening adapted to receive the padding member, and fastener for closing the opening;

inserting the padding member through the opening and into the upholstery cover;

fastening the fastener to close the upholstery cover to form a cushion for the article of furniture; and placing the cushion on the article of furniture.

5. The method of claim 1, wherein said recess and said connector element each include complementary, oblong-shaped portions and a narrowed portion, said narrowed portion located adjacent a said edge, whereby said oblong portion of said connector element prevents said connector element from being pulled out of said frame member in a direction parallel to said planar surfaces.

6. A method of assembling a ready-to-assemble article of furniture, comprising:

providing; a disassembled frame, including at least two frame members, each said frame members including an edge and a planar surface, said frame members having interlocking portions, two said planar surfaces further including respectively at least one of a recess and an aperture; at least one insertable plastic, unthreaded connector element which is separate from the frame members; and at least one metal threaded fastener;

inserting the connector element into the recess of one frame member in a direction which is perpendicular to said planar surface;

interconnecting the interlocking portions of the frame members; and securing the frame members together by inserting the threaded fastener through the aperture of said other frame member and threading said fastener into the connector element in a direction which is substantially perpendicular to the direction of insertion of said connector element.

7. The method off claim 6, wherein the recess and the connector element each include complementary, oblong-shaped portions and a narrowed portion, said narrowed portion located adjacent a said edge, whereby said oblong portion of said connector element prevents said connector element from being pulled out of said frame member in a direction parallel to said planar surfaces.

8. The method according to claim 1, wherein said connector element is made of plastic and said fastener is made of metal, said metal fastener forming a thread in said plastic fastener.

* * * * *